US007654537B2

(12) United States Patent
Scarano

(10) Patent No.: US 7,654,537 B2
(45) Date of Patent: Feb. 2, 2010

(54) GASKET FOR A VALVE IN AN INTERNAL COMBUSTION ENGINE

(75) Inventor: Francesco Scarano, Turin (IT)

(73) Assignee: Corcos Industriale S.a.s. di Freudenberg & Cosso S.r.l., Pinerolo (IT)

( * ) Notice: Subject to any disclaimer, the term of this patent is extended or adjusted under 35 U.S.C. 154(b) by 166 days.

(21) Appl. No.: 11/961,389

(22) Filed: Dec. 20, 2007

(65) Prior Publication Data

US 2008/0157480 A1 Jul. 3, 2008

(30) Foreign Application Priority Data

Dec. 29, 2006 (EP) ..... 06425889

(51) Int. Cl.
*F02F 11/00* (2006.01)

(52) U.S. Cl. ..... 277/502; 277/551; 123/188.6; 123/188.9; 251/214

(58) Field of Classification Search ..... 277/502, 277/551; 123/188.6, 188.9; 251/214
See application file for complete search history.

(56) References Cited

U.S. PATENT DOCUMENTS 3,450,411 A * 6/1969 Skinner, Sr. ..... 277/577
6,571,761 B1 6/2003 Leimer
6,679,502 B1 * 1/2004 Leimer ..... 277/502
6,938,877 B2 * 9/2005 McArthy et al. ..... 251/214
2005/0001196 A1 1/2005 McArthy et al.

FOREIGN PATENT DOCUMENTS

| | | |
|---|---|---|
| DE | 3326811 A1 * | 2/1985 |
| FR | 2728017 | 6/1996 |
| JP | 08326925 | 12/1996 |
| JP | 2004011867 | 1/2004 |

* cited by examiner

*Primary Examiner*—Vishal Patel
(74) *Attorney, Agent, or Firm*—Harness, Dickey & Pierce, P.L.C.; Ronald W. Wangerow

(57) ABSTRACT

A gasket for a valve in an internal combustion engine is provided with a support element having a tubular configuration according to an axis and coaxially mounted on the valve. An elastically deformable element is interposed between the support element and the valve. The support element includes a first portion elongated according to the above mentioned axis, and a second portion extending from the first portion in a direction transversal to the axis, at least partially housed in an annular seat of the elastically deformable element and having its radially outermost end connected to the first portion itself. The support element comprises a third portion extending from the radially innermost end of the second portion and folded on the second portion itself so as to generate, in the folding area, a rounded edge cooperating with the annular seat of the elastically deformable element.

3 Claims, 2 Drawing Sheets

GASKET FOR A VALVE IN AN INTERNAL COMBUSTION ENGINE

CROSS-REFERENCE TO RELATED APPLICATIONS

Figure 1:
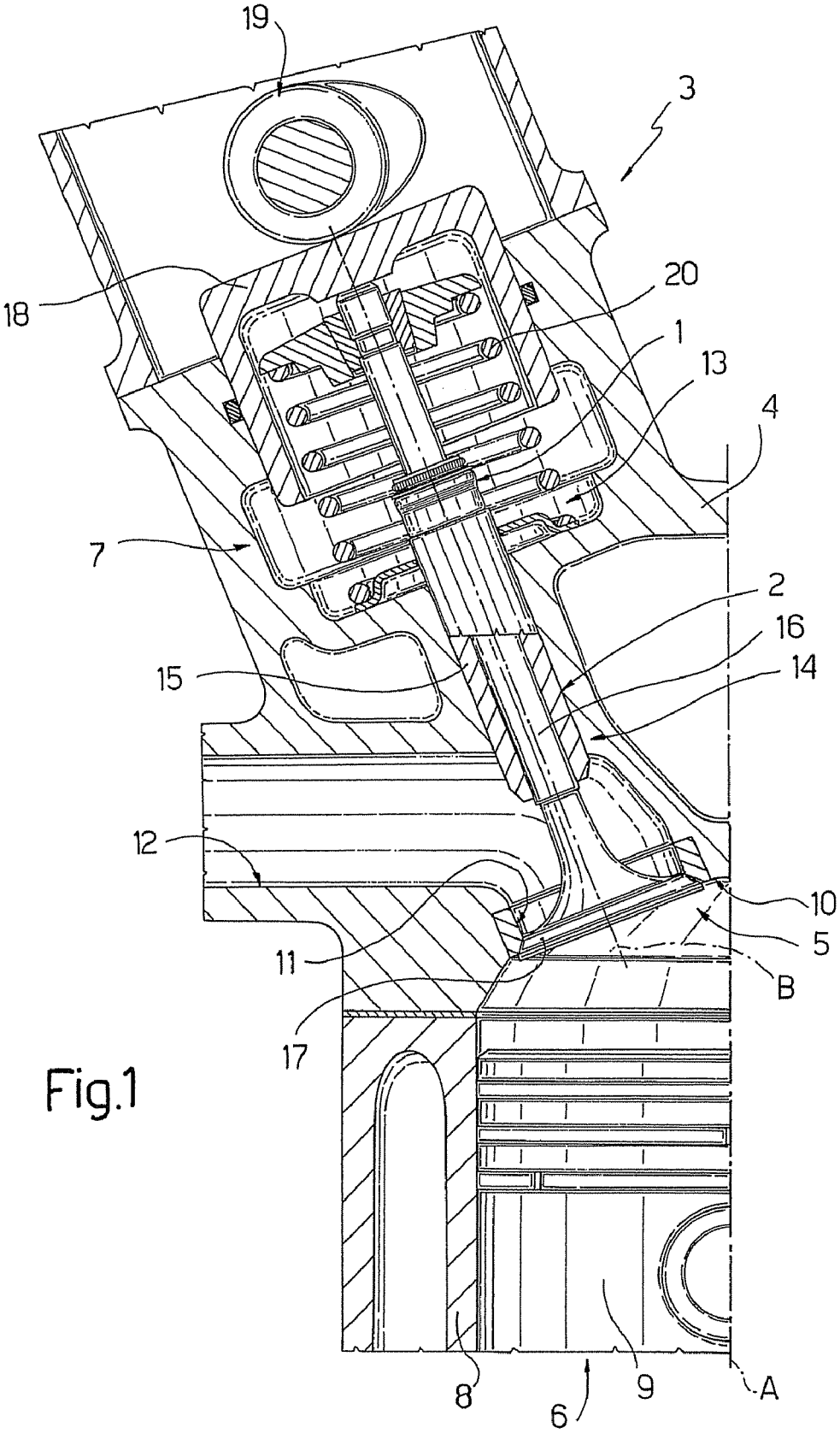

This application claims the benefit of European Patent Application No. EP06425889.0, filed Dec. 29, 2006, the disclosure of which is incorporated herein by reference.

FIELD

The present disclosure relates to a gasket for a valve in an internal combustion engine.

BACKGROUND AND SUMMARY

The statements in this section merely provide background information related to the present disclosure and may not constitute prior art.

There are known internal combustion engines for motor vehicles comprising a head bearing one or more cylinders, within which the work cycle is carried out, and which are placed in communication with respective combustion chambers of the engine itself. On the above mentioned head, there are further obtained appropriate seats intended to let the combustion chamber communicate with ducts adapted to supply a mixture of unburnt fuel and air to said chamber ("suction ducts"), and discharge the burnt gases from said combustion chamber ("discharge ducts").

The flows from and to each combustion chamber are controlled by appropriate valves operating on the mentioned seats. Specifically, each valve generally comprises a guide element fixed within a cavity of the engine head and a slidingly displaceable rod in opposite directions within a through seat defined by the guide element and bearing, at one end, a clogging section to close the connection between the relative suction or discharge duct and the corresponding combustion chamber.

The opposite end of the rod of the valve axially protrudes from the relative guide element and is adapted to receive driving forces from a relative control device.

On the valves of the above described type, there are normally mounted seal gaskets for the lubricating oil normally circulating in the engines. Such gaskets, in one of the most commonly known forms, comprise a support or reinforcing element having a substantially tubular configuration, generally made of a metal material, and an element made of elastomeric material interposed between the support element and the valve.

Specifically, the elastomeric element typically comprises a first portion adapted to cooperate by means of its inner surface with the outer surface of the upper portion of the guide element, and a second portion adapted to directly cooperate with the rod of the valve.

The gaskets of the above described type are widely used in all internal combustion engines to control the amount of lubricating oil that flows from the distribution area towards the combustion chambers. An excessive flow of lubricating oil causes a deterioration in the efficiency of the engine and a drop in the performance of the motor vehicle catalytic converter as well as an evident excessive consumption of the oil itself. On the other hand, an insufficient flow determines an increase in the wear and the noise of the valves together with the occurrence of local temperature peaks. These phenomena may determine a premature damage of the valves following the seizure of the rod of the valves themselves within the guide element.

The known gaskets allow the construction of a static-type seal by means of the first portion of the elastomeric element operating on the guide element of the relative valve, and the construction of a dynamic-type seal by means of the second portion of the elastomeric element cooperating with the rod. Specifically, the static seal must ensure a certain degree of radial compression on the guide element in order to avoid the throttling of the lubricating oil to the combustion chambers and at the same time maintain the gasket itself in position, whereas the dynamic seal is designed to allow the minimum flow of oil required for the lubrication of the coupling between rod and guide element.

The support element comprises a first substantially cylindrical portion and a second discoidal annular portion, extending from an axial end of the first portion towards the valve in a transversal direction with respect to the axis of the first portion itself; such a second portion is partially drowned in the elastomeric element.

The applicant has noted that, in use, the cyclic stresses which the elastomeric element is subjected to may determine, in its annular seat housing the second portion of the support element, a concentration of stresses with the possible fatigue cracking of the elastomeric element itself.

The present disclosure provides a gasket for a valve in an internal combustion engine, which overcomes the drawbacks related to the gaskets of the known and above specified type in a simple and cost-effective manner.

The present disclosure refers to a gasket for a valve in an internal combustion engine, comprising: a support element having a tubular configuration according to an axis and coaxially mounted on said valve; and an elastically deformable element interposed between said support element and said valve; said support element comprising a first portion elongated according to said axis, and a second portion extending from said first portion in a direction transversal to said axis, at least partially housed in an annular seat of said elastically deformable element and having its radially outermost end connected to the first portion itself, wherein said support element comprises a third portion extending from the radially innermost end of said second portion and folded on the second portion itself so as to generate, in the folding area, a rounded edge cooperating with said annular seat of said elastically deformable element.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 2:
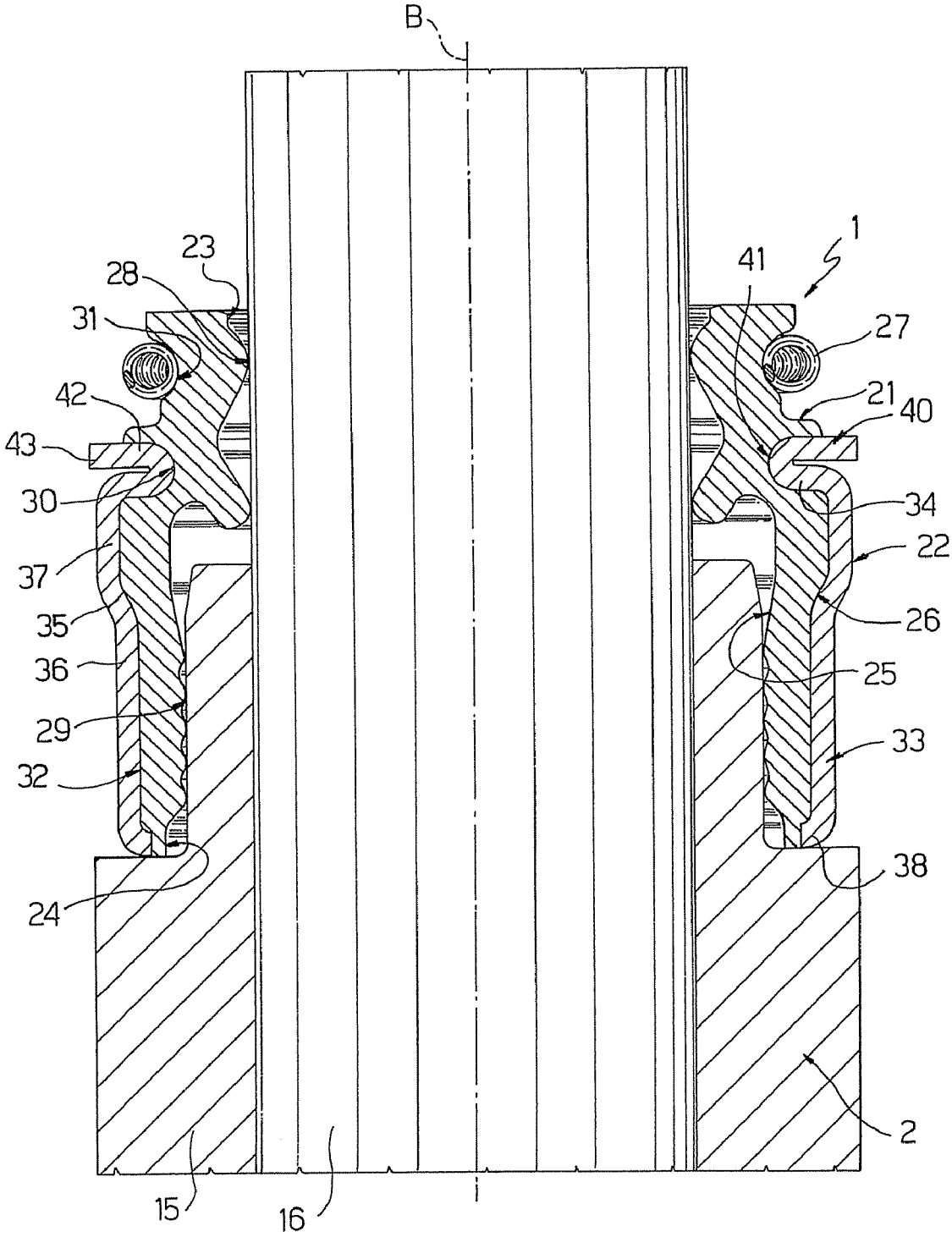

FIG. 1 is a partial cross-section view of an internal combustion engine provided with a gasket for a valve constructed according to the principles of the present disclosure; and FIG. 2 is an axial cross-section view on an enlarged scale of the valve and gasket in FIG. 1.

DETAILED DESCRIPTION

The following description is merely exemplary in nature and is not intended to limit the present disclosure, application, or uses. It should be understood that throughout the drawings, corresponding reference numerals indicate like or corresponding parts and features.

With reference to FIG. 1, numeral 1 indicates, as a whole, a gasket according to the present disclosure for a valve 2 in an internal combustion engine 3, intrinsically known and only shown as far as required for the understanding of the present disclosure.

In greater detail, in FIG. 1 engine 3 is shown as regards to a portion of a head 4 symmetrically extending with respect to an axis A and only half shown.

The above mentioned portion of the head 4 defines a combustion chamber 5 (only partially shown), within which a combustible gas is oxidised in the presence of comburent air so as to convert the chemical energy contained in the combustible gas to pressure energy, and a cylinder 6 (also only partially shown) having an axis A which is fluidically connected to the combustion chamber 5 and adapted to convert the above mentioned pressure energy to mechanical energy.

Moreover, the portion of the head 4 houses a supply assembly 7 adapted to supply a mixture comprising the combustible gas and the comburent air within the combustion chamber 5, and a discharge assembly (intrinsically known and not shown) adapted to discharge the burnt gas and air from the combustion chamber 5 itself towards the environment external to the engine 3.

In greater detail, the cylinder 6 comprises a liner 8 and a piston 9, which is slidable under the action of the fuel pressure within the liner 8 itself according to an alternative motion directed along the axis A and is operatively connected (in a manner which is not shown) to a mover to convert pressure energy to mechanical energy.

The combustion chamber 5 is axially delimited by an end wall 10 and is open, on a part axially opposite with respect to the end wall 10, towards the cylinder 6.

The end wall 10 of the combustion chamber 5 displays a pair of circular through apertures (only one of which is shown and is indicated by numeral 11), positioned symmetrically with respect to the axis A. More specifically, the aperture indicated by 11 is adapted to allow the transit of the mixture comprising the combustible gas and the comburent air coming from the supply assembly 7 within the combustion chamber 5; the aperture, which is not shown, is adapted to allow the transit of burnt gas and air from the combustion chamber 5 to the discharge assembly (which is also not shown).

The supply assembly 7 and the discharge assembly are fairly similar and extend reciprocally symmetrical with respect to the axis A; for the sake of simplicity, the present description will only refer to the supply assembly 7, being understood that considerations similar to those set forth for the supply assembly 7 will also be applicable to the discharge assembly.

In detail, the supply assembly 7 comprises a supply duct 12, which extends from the aperture 11 towards a reservoir (not shown) of the combustible gas of the engine 1, and cooperates with a valve 2 adapted to engage, according to predetermined time laws, the aperture 11 so as to adjust the flow of combustible gas and comburent air from the supply duct 12 itself to the combustion chamber 5.

The valve 2, shown in detail in FIG. 2, is housed in a seat 13, which is obtained in the head 6 and normally contains lubricating oil.

More precisely, the seat 13 extends symmetrically with respect to an axis B, transversely with respect to the axis A, and results open at a terminal segment thereof 14 which is axial towards the supply duct 12.

The valve 2 comprises a tubular guide element 15 which is interference-fitted within the terminal portion 14 of the seat 13, and a slidingly displaceable rod 16 in opposite directions along axis B within the guide element 15.

On the outer circumferential surface of the end of the guide element 15 opposite to the supply duct 12 a relative gasket 1 according to the disclosure is fitted coaxially surrounding both the guide element 15 and the rod 16.

In greater detail, the rod 16 protrudes on opposite parts of the guide element 15 and respectively comprises, at its opposite axial ends, a clogging section 17, intended to fluid-sealingly engage the aperture 11, and a section 18 adapted to receive a driving force by means of a control mechanism 19, which in this case is shown to be of the cam type.

The valve 2 further comprises a spring 20, in this case shown to be of the helicoidal type, which cooperates at its reciprocally opposite axial ends with the section 18 and with a delimitation wall of the seat 13 facing towards the clogging section 17; the spring 20 is adapted to generate a return elastic force on the rod 16 such that it is always maintained in contact with the control mechanism 19, at its section 18.

With special reference to FIG. 2, the gasket 1 displays a substantially tubular configuration according to a coinciding axis, in mounting conditions, with the axis B.

More precisely, the gasket 1 comprises an annular shaped elastomeric element 21, and a support element 22 which is coaxially fixed on the elastomeric element 21 itself to press the latter, in a radial direction with respect to the axis B, on the guide element 15 and on the rod 16. In practice, the elastomeric element 21 is interposed between the support element 22 and the valve 2.

The elastomeric element 21 defines, moving along the axis B towards the combustion chamber 5, first a dynamic type seal adapted to allow the transit of a minimum flow of oil required for the lubrication of the coupling between the rod 16 and the guide element 15, and then a static type seal to prevent the oil flow towards the combustion chamber 5.

In greater detail, the elastomeric element 21 is delimited by two discoidal sections 23, 24 having an axial end, which are opposite to one another, by an inner circumferential surface 25 adapted to cooperate partially with the rod 16 and partially with the guide element 15 to obtain the above mentioned seals, and an outer circumferential surface 26 adapted to couple with the support element 22 and with an annular elastic collar 27 so as to press the inner circumferential surface 25 on the rod 16 and on the guide element 15.

The section 23, in mounting conditions, faces the control mechanism 19 and the rod 16 passes through it; the section 24, in mounting conditions, faces towards the combustion chamber 5, and both the rod 16 and the guide element 15 pass through it.

The inner circumferential surface 25 of the elastomeric element 21 comprises, in a position adjacent to the section 23, a section 28 having a minimum diameter, adapted to be radially pressed by the elastic collar 27 against the rod 16 to define a circumferential dynamic type seal line, which allows the outflow of a minimum oil flow in virtue of the sliding coupling with the rod 16 itself.

The inner circumferential surface 25 of the elastomeric element 21 further comprises, in a position adjacent to the section 24, a substantially cylindrical portion 29, adapted to be radially pressed by the support element 22 against the guide element 15 so as to define a cylindrical static type seal area.

The outer circumferential surface 26 of the elastomeric element 21 defines, near the section 28, a notch 30, the function of which will become clear hereinafter; the notch 30 subdivides the outer circumferential surface 26 in a housing portion 31 of the elastic collar 27, extending towards the section 23, and in an elongated portion 32 extending towards the section 24 and adapted to couple, together with the notch 30 itself, with the support element 22.

With special reference to FIG. 2, the support element 22 comprises a first portion 33, substantially cylindrical and elongated according to the axis B, and a second discoidal annular portion 34, extending from an axial end of the portion 33 towards valve 2 in a transversal direction, in this case orthogonal, with respect to the axis B.

The portion 33 can display an intermediate segment 35 having increasing radial size towards the portion 34 so as to reduce the size of the elastomeric element 21.

More precisely, the portion 33 is adapted to cooperate with the portion 32 of the outer circumferential surface 26 of the elastomeric element 21, and comprises a segment 36 and a segment 37, having radial size greater than the segment 36, which define opposite axial ends of the portion 33 itself.

The segments 36 and 37 display a cylindrical configuration and are both connected to the intermediate segment 35, which displays a frustoconical configuration.

In the case shown, the segment 36 and the segment 37 display greater extensions with respect to the intermediate segment 35 in the direction of the axis B.

The segment 36 further displays a free axial end 38 which is folded towards the axis B so as to axially retain the elastomeric element 21.

The segment 37 displays, on the part opposite to the intermediate segment 35, an axial end connected to the radially outermost end of the portion 34.

Advantageously, the support element 22 comprises a further portion 40 extending from the radially innermost end of the portion 34 and folded on the portion 34 itself so as to generate, in the folding area, a rounded edge 41 cooperating with the notch 30 of the elastomeric element 21.

In the case shown, the portion 40 is folded by 180° on the portion 34.

As shown in FIG. 2, the portion 40 comprises a fraction 42, which is fixed within the notch 30 together with the portion 34, and a fraction 43, radially more external with respect to the fraction 42, which is free on the side facing towards the section 23 so as to be able to receive an action with a component parallel to the axis B to facilitate the mounting of the gasket 1 on the guide element 15 of the relative valve 2.

It may finally be noted that the portion 40, on the opposite part of the relative valve 2, protrudes with respect to the portion 34 in a direction transversal to the axis B.

From a test for the features of the gasket 1 made according to the principles of the present disclosure, the advantages it allows to obtain are clear.

Specifically, the presence on the portion 34 of the support element 22 which is drowned in the elastomeric element 21 of a further portion 40 folded on the portion 34 itself so as to form a rounded edge 41 allows to obtain an increase in the curvature radius of the profile of the notch 30 which houses the portions 34 and 40 of the support element 22 with respect to the known solutions; in this manner, it is possible to reduce the build-up of the tension within the elastomeric element 21 when the external stress is the same.

It is finally clear that modifications and variants not departing from the scope of protection as defined by the claims may be made to the gasket 1 here described and shown.

What is claimed is:

1. A gasket for sealing a rod disposed in a guide element of a valve for an internal combustion engine, comprising:

a tubular support element having a first portion terminating at a first end and a second portion terminating at a second end opposite the first end;

said tubular support having a first segment connected to said first end with a first outer circumferential surface, a second segment connected to said second end with a second outer circumferential surface, an intermediate segment connecting said first segment and said second segment, said second outer circumferential surface extending radially outward of said first outer circumferential surface, an elastomeric seal element secured to said tubular support element, said elastomeric seal element having a static sealing portion proximate said first end capable of sealing engagement with the guide element and a dynamic sealing portion proximate said second end capable of sealing engagement with the rod, said first end extends radially inward toward a longitudinal axis of the gasket, wherein said second portion of said tubular support element includes a first radial portion that entirely extends radially inward toward the longitudinal axis, a second radial portion that entirely extends radially outward away from said longitudinal axis and terminates at said second end, and a rounded edge portion directly and axially connecting said first radial portion and said second radial portion and being seated in a notch formed in said dynamic sealing portion, said first radial portion extends radially inward toward the longitudinal axis to a greater extent than said first end, said second radial portion extends radially outward from said longitudinal axis to a greater extent than said second outer circumferential surface.

2. The gasket of claim 1, wherein said first and second radial portions extend entirely transverse to said longitudinal axis.

3. The gasket of claim 1, wherein said intermediate segment having a frustoconical surface.

* * * * *